US008840729B1

(12) United States Patent
Herren et al.

(10) Patent No.: US 8,840,729 B1
(45) Date of Patent: Sep. 23, 2014

(54) AIR CONDITIONING DRAIN CLEANING SYSTEM

(76) Inventors: Michael Herren, Vinton, LA (US); Douglas Comeaux, Sulphur, LA (US)

( * ) Notice: Subject to any disclaimer, the term of this patent is extended or adjusted under 35 U.S.C. 154(b) by 757 days.

(21) Appl. No.: 13/070,660

(22) Filed: Mar. 24, 2011

(51) Int. Cl.
*B08B 3/00* (2006.01)

(52) U.S. Cl.
USPC ..... 134/15; 134/31; 62/150; 62/172; 62/303; 137/112; 137/209

(58) Field of Classification Search
USPC ..... 134/22.1, 22.12, 31, 34, 37, 166 C, 134/169 C, 171, 195; 62/150, 272, 303; 137/240, 268, 112, 209, 625.47
See application file for complete search history.

(56) References Cited

U.S. PATENT DOCUMENTS

| | | | | |
|---|---|---|---|---|
| 4,444,217 | A * | 4/1984 | Cummings et al. | 137/195 |
| 4,770,196 | A | 9/1988 | Osswald | |
| 4,962,778 | A | 10/1990 | Driskill | |
| 4,998,412 | A * | 3/1991 | Bell | 62/126 |
| 5,085,244 | A * | 2/1992 | Funk | 137/240 |
| 5,680,877 | A | 10/1997 | Edstrand et al. | |
| 6,068,023 | A | 5/2000 | Potter | |
| 6,182,453 | B1 | 2/2001 | Forsberg | |
| 6,213,002 | B1 | 4/2001 | Batten et al. | |
| 6,261,462 | B1 | 7/2001 | Batten et al. | |
| 6,297,871 | B1 | 10/2001 | Hagiwara | |
| 6,301,917 | B1 | 10/2001 | Lacoste | |
| 6,442,956 | B1 | 9/2002 | Herren | |
| 6,487,867 | B1 | 12/2002 | Herren | |
| 6,708,717 | B1 | 3/2004 | Coogle | |
| 6,976,367 | B2 | 12/2005 | Spanger | |
| 7,191,606 | B1 | 3/2007 | Dwyer | |
| 7,392,658 | B1 | 7/2008 | Hardy, III | |
| 2001/0019399 | A1 | 9/2001 | Hagiwara | |

* cited by examiner

*Primary Examiner* — Saeed T Chaudhry
(74) *Attorney, Agent, or Firm* — Goldstein Law Offices, P.C.

(57) ABSTRACT

An air conditioning drain cleaning system with an automated blow-out cycle to clean out an evaporator pan drain pipe. The system has a pneumatic valve assembly, a controller, a float level switch assembly and a plurality of air lines in a manifold for actuating the pneumatic valve assembly and blowing out the drain pipe. The controller directs the system to initiate or repeat a blow-out cycle until the drain pipe is clear. The pneumatic valve assembly bisects the drain pipe to selectively close the pipe for cleaning with a pair of high pressure air shots, one shot toward each pipe end to dislodge a clog. The float level switch assembly signals the controller if the condensate level in the drain pan drops. If the condensate level does not drop, the controller initiates a further blow-out cycle at increased pressures until the line is clear.

4 Claims, 6 Drawing Sheets

AIR CONDITIONING DRAIN CLEANING SYSTEM

BACKGROUND OF THE INVENTION

The invention relates generally to an air conditioning drain cleaning system. More particularly, the invention relates to an air conditioning drain cleaning system with an automated blow-out cycle to clean out an air conditioner evaporator drain pipe.

Air conditioning systems are ubiquitous and have changed the way people work and live, making skyscrapers possible and making people comfortable year-round regardless of external weather. All have come to expect comfortable, climate-controlled building interiors for living, working, exercising, eating and sleeping. Air conditioning systems are now critical components of both commercial and home environments and their continuous operation is crucial during times of high heat and humidity.

Air conditioners require a liquid refrigerant to pass through coils of an evaporator, and as the refrigerant evaporates in the coils, it chills the coils, cooling and dehumidifying the air. Water condenses on the coils and collects in a pan below the evaporator coils. The drain pan collects the condensate and directs it to a sewer system or an outside area through a drain line. Unfortunately, drain lines are prone to clogging over time. When air conditioning (AC) equipment is in constant or near constant use, the need for service increases. This is certainly the case in warm locations having extended periods of high temperature and humidity levels. Blockage can occur in the drain pan or the drain line due to debris, algae, mold, accumulated particulates or scale. The blockage causes the condensate to accumulate in the drain pan, and eventually, the condensate overflows to cause damage to the building and furnishings. An AC system that is otherwise capable of problem free operation for long intervals of time may require costly and periodic service just to clear the drain pan and pipe.

To service the pipe and remove the blockage, the user has had to cut or disconnect the drain line from the pan and clean it out with pressure. This process resulted in either replacing or repairing the drain line, often with unsatisfactory results. This process had to be repeated often.

Many have proposed solutions such as placing a tee-connection with a valve in the line downstream of the pan and manually closing the valve in one direction allows air from an external source to be forced upstream or closing in the other direction allows the air to be forced downstream, depending on the location of the clog. Others have enhanced the tee-connection with an air flow tube that provides the air for clearing the clog or provides an easy method to connect the tee-connection and flush with compressed air or liquid.

Alternatively, some have approached the problem by having a condensate level sensor in the drain pan that activates a pump on the drainage system when the condensate level approaches overflow. Another suggestion was an alarm in the drain trap monitoring the flow of water and alerting an operator when the drain is dry. Some have focused on prevention and suggested adding a biocide or a rinsing solution to periodically prevent clogs.

My own patented invention provides for sealing a low volume drain tube, pressurizing the drain tube, and unsealing the drain tube thereby causing the clearing and blowing out of any contaminants and debris present within the drain tube. The system includes a timer and controller that may be employed for causing a clearing and blowing out of the drain tube at pre-selected and regular intervals.

My other patented invention provides for periodically transferring a pre-selected volume of treatment liquid to a collection pan in order to treat and prevent the clogging of the collection pan. The system includes a treatment liquid reservoir, at least one coupling and treatment of the collection pan by the periodic transfer of the volume of treatment liquid from the reservoir to the collection pan through the couplings.

While these units may be suitable for the particular purpose employed, or for general use, they would not be as suitable for the purposes of the present invention as disclosed hereafter.

SUMMARY OF THE INVENTION

It is an object of the invention to produce an air conditioning drain cleaning system that removes a clog in a drain pipe attached to a drain pan in an environmentally friendly manner. Accordingly, the invention is an air conditioning drain cleaning system that flushes a clog out of the drain pipe with environmentally friendly compressed air without using a corrosive or caustic chemical to dissolve the clog.

It is another object of the invention to produce an air conditioning drain cleaning system that eliminates the need to remove system cooling and draining hardware to clean or remove a clog, saving cost. Accordingly, the invention is an air conditioning drain cleaning system that installs a pneumatic valve assembly in a drain pipe and directs compressed air into the drain pipe to clear clogs while maintaining the cooling and draining hardware in place.

It is yet another object of the invention to produce an air conditioning drain cleaning system that automatically removes a clog in a drain pipe attached to a drain pan. Accordingly, the invention is an air conditioning drain cleaning system that initiates a blow-out cycle to flush a clog out of the drain pipe when a float level switch signals a controller that the condensate level in the drain pan is high, indicating a clog in the drain pipe.

It is a further object of the invention to produce an air conditioning drain cleaning system that prevents water damage from clogged drain pans overflowing into surrounding areas, causing water damage. Accordingly, the invention is an air conditioning drain cleaning system that has a float level switch that detects a high level of condensate in the drain pan, indicating a clogged drain pipe and initiates a drain cleaning blow-out cycle before the drain pan overflows, damaging nearby items.

It is yet a further object of the invention to produce an air conditioning drain cleaning system that maintains a clean-flowing drain pipe attached to a drain pan. Accordingly, the invention is an air conditioning drain cleaning system that periodically cleans out the drain pipe at pre-set intervals programmed into a controller that initiates a blow-out cycle to clean out the drain pipe.

The invention is an air conditioning drain cleaning system with an automated blow-out cycle to clean out a drain pipe on the air conditioning evaporator drain pan. The drain cleaning system has a pneumatic valve assembly, a controller, a float level switch assembly and a plurality of air lines in a manifold for actuating the pneumatic valve assembly and blowing out the drain pipe. The controller directs the system to initiate a blow-out cycle when the drain is clogged or to repeat the blow-out cycle until the drain pipe is clear. The pneumatic valve assembly is inserted in the drain pipe to selectively open and close the drain for cleaning with air pressure. When the valve is closed, bisecting and sealing off the drain pipe, a pair of high pressure air shots is selectively introduced into the drain pipe, one toward the drain pan and one toward the outlet to dislodge a clog. The float level switch assembly signals the controller if the condensate level in the drain pan drops. If the condensate level does not drop, the controller initiates a further blow-out cycle at increased pressures until the line is clear.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
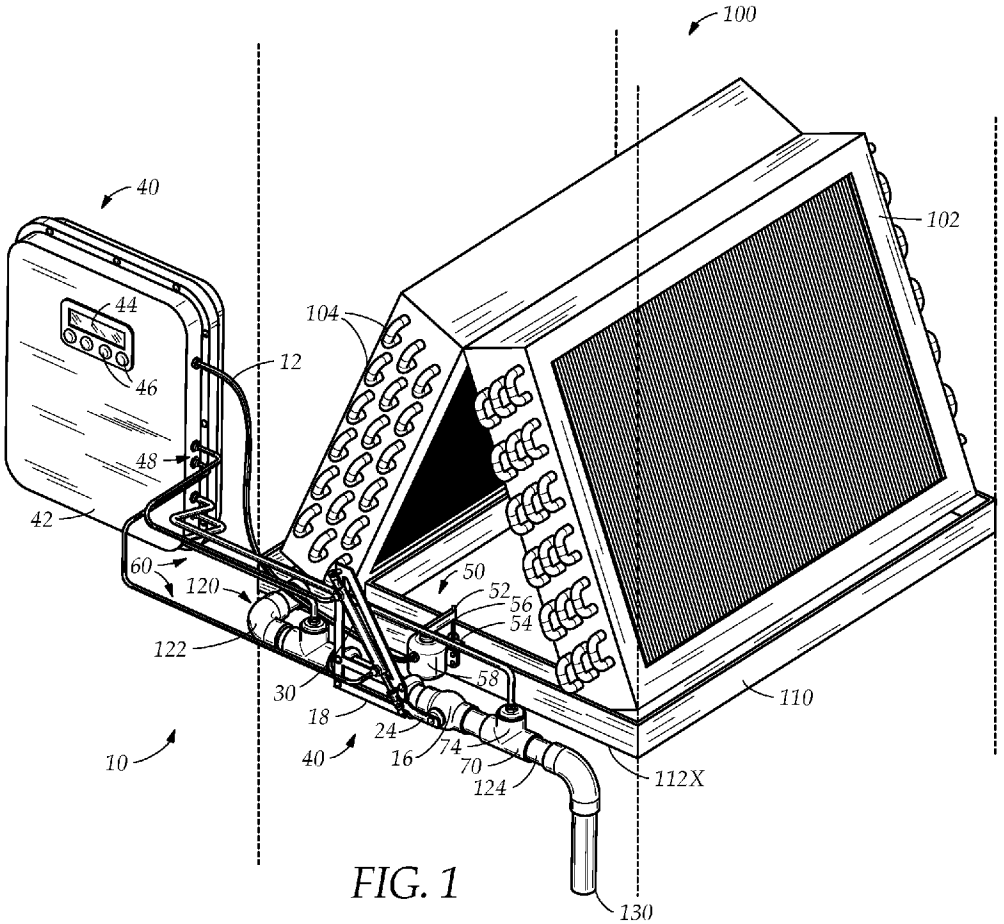
FIG. 1 is a diagrammatic perspective view of a drain cleaning system installed in an air conditioning condensate drainage system.

FIG. 1 illustrates an air conditioning (AC) drain cleaning system 10 installed on an air conditioning condensate drainage system 100. An evaporator 102 sits in a collection drain pan 102, the pan 102 collecting condensate from a plurality of coils 104. The condensate, which is mainly water, flows into the drain pan 110 and out a drain pipe 120. The condensate flows out an outlet 130 on the drain pipe 120, either to ground or to a sewer system. The drain pipe 120 suffers from frequent clogging from algae, debris, mold and accumulated particulates. The drain cleaning system 10 has a pneumatic valve assembly 20, a controller 40, a float level switch assembly 50 and a plurality of air lines 60 in a manifold 48 for actuating the pneumatic valve assembly 20 and blowing out the drain pipe 120. The controller 40 directs the system 10 to initiate a blow-out cycle or to repeat the blow-out cycle with incrementally increasing pressure until the drain pipe 120 is clear or until a maximum pressure is reached and an alarm is sounded.

The pneumatic valve assembly 20 is inserted in the drain pipe 120 to selectively open and close the drain pipe 120 for cleaning with air pressure. The pneumatic valve assembly 20 bisects the drain pipe 120 into a pair of drain pipe portions, a first portion connecting to the drain pan 122 and a second portion 124 leading to the outlet 130. The pneumatic valve assembly 20 has a valve and a pneumatic cylinder 30, the pneumatic cylinder actuating the valve. When the valve is closed, sealing off the drain pipe portions 122, 124, a pair of high pressure air shots is selectively introduced into the drain pipe 120 to blow out a clog during the blow-out cycle. An initial first shot of compressed air is directed toward the drain pan 110 into the first drain pipe portion 122 to dislodge a clog. A second shot of compressed air is directed toward the outlet 130 into a second drain pipe portion 124. The controller 40 actuates the pneumatic cylinder 30 to open the valve, allowing condensate to flow from the drain pan 120 to the outlet 130. The float level switch assembly 50 monitors for changes in the level of condensate in the drain pan 110. If the drain pan 110 is clear of condensate, the float level switch assembly 50 signals the controller 40, and the controller will end the blow-out cycle. If the float level switch assembly 50 does not signal the controller 40 within a pre-set time period that the level of condensate in the drain pan 110 has decreased, indicating that the clog has not cleared, the controller 40 actuates the pneumatic valve assembly 40 to close the valve and initiates an additional cycle of compressed air shots, using a higher pressure setting, to blow out the drain pipe 120. The cycles continue until the float level switch assembly 50 signals the controller 40 that the condensate level has decreased, indicating that the clog has been cleared and the drainage system is flowing freely or until a pressure transducer in the controller senses that the maximum system air pressure has been reached and an alarm is signaled. If the alarm is signaled, the system resets and stands idle. In one embodiment, the controller 40 signals a release of a descaling, degreasing and disinfecting chemical rinse onto the coils and the drain pan to inhibit clog formation.

Figure 2:
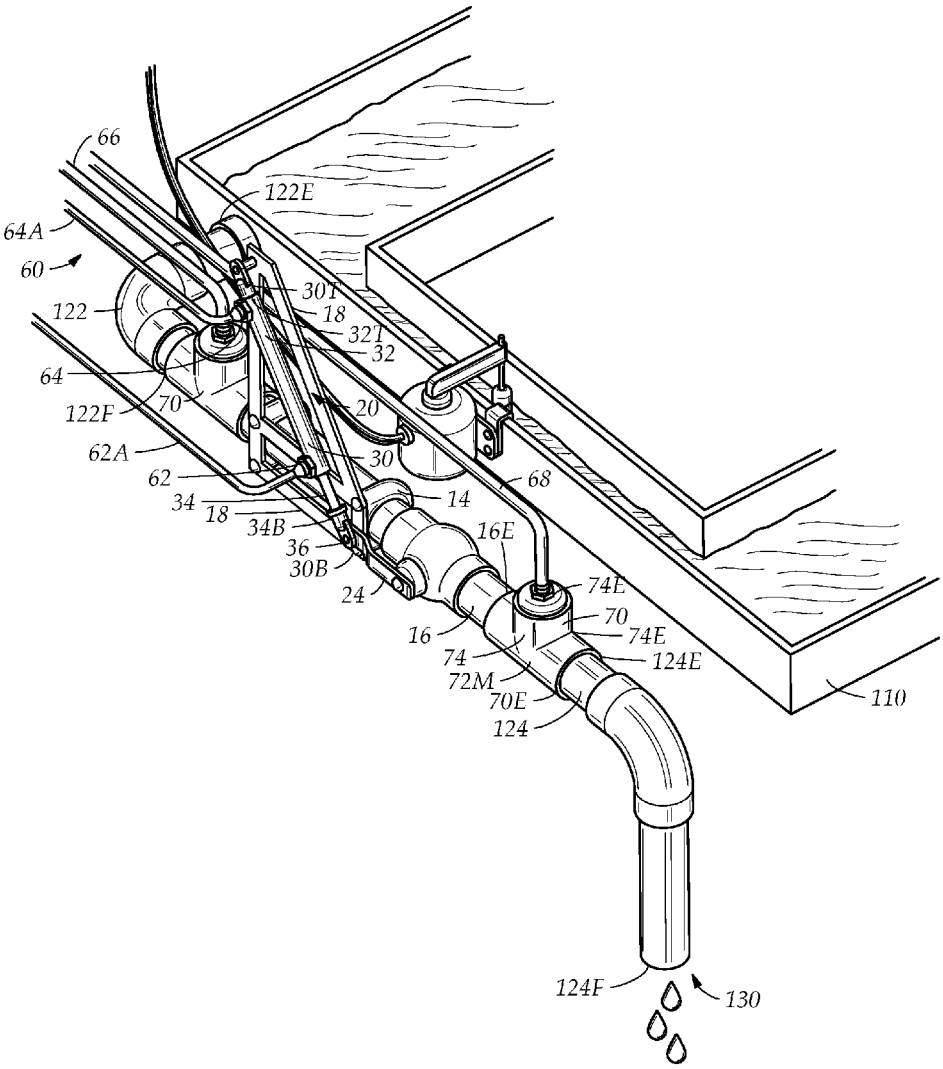
FIG. 2 is a diagrammatic perspective view of a pneumatic valve of the drain cleaning system installed on a drain pipe of the condensate drainage system.

Once the clog is cleared, the controller 40 resets the system with the valve in the open position, the system in an idle state. The system can preferably switch on at set intervals to maintain an unclogged system or when the float level switch assembly 50 indicates the drain pipe 120 is clogged. Alternatively, the system has a manual override that allows the user to switch the system on for testing, or at the beginning and end of cooling season, for example. In one embodiment, the controller 40 shuts down the AC system and starts an air compressor to provide compressed air to the system when the first blow-out cycle is initiated by the controller 40. In this embodiment, when the controller resets the system, the air compressor is turned off and the AC system is restarted. In a further embodiment, power is transferred between the air compressor and the FIG. 2 shows in greater detail the components of the pneumatic valve assembly 20 and the air lines 60 connecting to the drain pipe and pneumatic valve assembly 20. The drain pipe portions 122, 124 each have a pair of ends 122E, 122F, 124E 124F. A first end 122E of the first portion 122 connects to the drain pan 110 and a second end 124F of the second portion 124 is the outlet 130. Connecting the second end 122F of the drain pipe first portion 122 and the first end 124E of the drain pipe outlet portion 124 leading to the outlet 130 is the pneumatic valve assembly 20 mounted on a bracket 18. The valve assembly 20 has a pipe segment 16 with a pair of ends 16E, each end connecting to a pair of tee-connectors 70, each tee connector connecting to the ends 122F, 124E of the drain pipe portions 122, 124. Inside the pipe segment 16 is a main valve that selectively switches from a horizontal position, opening the pipe segment 16 for condensate flow, to a vertical position, stopping condensate through the pipe segment. The main valve has an external lever 24 that selectively moves the valve between the horizontal and vertical positions.

Actuating the main valve is the pneumatic cylinder 30 attached to the lever 24. The pneumatic cylinder 30 has a piston rod 34, a top 30T and a bottom 30B, with a cylinder barrel 32 having a head 32H and a bottom 32B, the cylinder barrel 32 at the top 30T of the pneumatic cylinder 30 and piston rod 34 extending towards the bottom 30B out from the barrel 32. The top 30T of pneumatic cylinder is attached to the bracket 18, the bracket held in place by a pair of pipe clamps 14, secured to the valve pipe segment 16. At the bottom of the piston rod is a clevis 36 attaching to the lever 24. In the illustration, a double acting cylinder is drawn, showing an in-stroke air inlet 62 at the bottom of the cylinder barrel and an out-stroke air inlet 64 at near the head of the cylinder barrel 32T. It is understood by those of ordinary skill that other types of pneumatic cylinders, such as single acting cylinder with a spring and a single air inlet, can actuate the main valve lever, within the inventive concept.

A pair of valve assembly air lines 62A, 64A are connected to the pneumatic cylinder barrel, a first air line 62A attached to the in-stroke air inlet 62 and a second air line 64A attached to the out-stroke air inlet 64. The air lines are connected to the manifold, the manifold in the controller, the controller connecting to a source of compressed air, such as an air compressor or a regulated air tank. How to provide compressed air to a system is well know to those of ordinary skill and are beyond the scope of this discussion. In one embodiment, in which the air compressor supplies the compressed air, the controller initiates the system by selectively turning on the air compressor.

Inserted between the pipe portions 122, 124 is the pair of tee-connectors 70, a first on the drain pan pipe portion 122 and a second on the outlet pipe portion 124. The tee-connector has a horizontal segment 72 with a middle 72M and a pair of ends 70E, and a vertical segment 74 with a pair of ends 74E, the first end 74E of vertical segment 74 connecting to the middle 72M of the horizontal segment 72. The pair of ends 70E of the horizontal segments connects the pneumatic valve pipe 16 segment to two pipe portions 122, 124, a first tee-connector 70 connecting the valve pipe segment 16 to the drain pan pipe portion 122 and a second tee-connector connects the valve pipe segment 16 to the outlet pipe portion 124. Attached to each vertical segment 74 of the tee-connectors 70 is a pair of high pressure air lines 66, 68 one air line to each vertical segment 74. The high pressure air lines 66, 68 are attached to the controller through the manifold in the controller, the manifold connecting to a high pressure compressed air source. It is understood that all air line connections in the drain cleaning system are gas-tight high pressure connections, such connections well known to those of ordinary skill in the art and are beyond the scope of this discussion.

Figure 8:
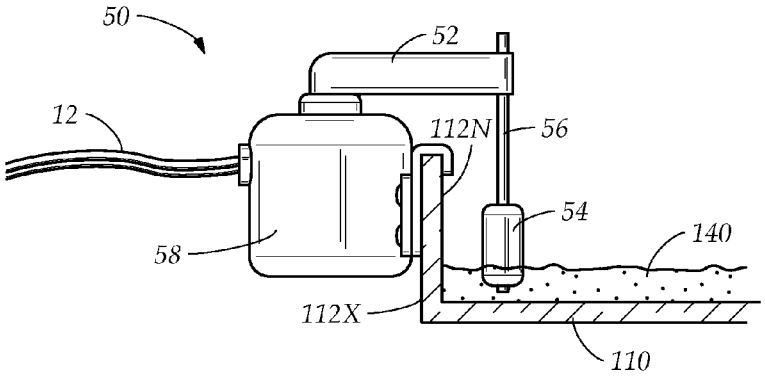
FIG. 8 is a side elevational view of a float level switch assembly with a float sensor in the drain pan, showing a low level of condensate in the drain pan.

Referring to FIG. 8, attached to the drain pan 110 is the float level switch assembly 50. The drain pan 110 has a wall 112, with an inside 112N and an outside 112X. The float level switch assembly 50 has an arm 52, a float 54, a rod 56 and a housing 58, the housing 58 attached to the outside 112X of the drain pan wall 112. Extending out from the housing 58 and over the drain pan wall 112 above the drain pan 110 is the arm 52. Suspended from the arm 52 is the float 54 disposed on the rod 56. The float 54 moves upward on the rod 56, indicating a high condensate 140 level, closing the circuit inside the housing 58. The float 54 moves downward on the rod 56, when little or no condensate 140 is present, opening the circuit. The housing 58 of the float level switch assembly 50 is electrically connected to the controller, signaling when the condensate 140 level is high, activating the system, and when the condensate 140 level is low or missing, inactivating the system. In one embodiment, the float level switch assembly 50 is wirelessly connected to the housing.

Figure 3:
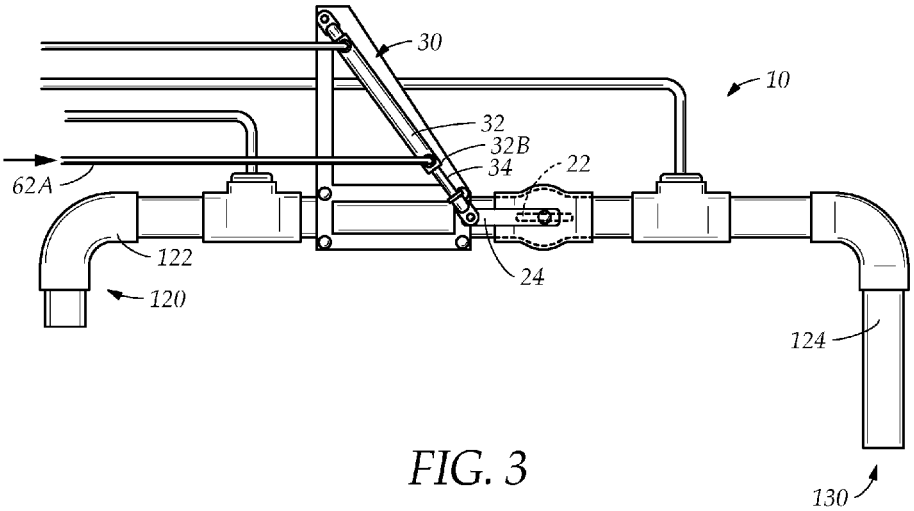
FIG. 3 is a side elevational view of the pneumatic valve in cross-section, showing the valve open for the condensate to flow through the drain pipe.

FIG. 3 shows the drain cleaning system 10 when the condensate drainage system is unclogged and functioning normally. The main valve 22, shown in outline, is a horizontal position, allowing the condensate to flow from the drain pan portion 122 of the drain pipe 120 through the outlet portion 124, exiting the condensate draining system through the outlet 130. The piston rod 34 of the pneumatic cylinder 30 is retracted, keeping the valve lever 24 in a horizontal position as well as the main valve 22. It is understood that in FIG. 3-6 the drain pipe portion 122 connecting to the drain pan is shown at a ninety-degree angle to a plane it occupies to better illustrate the system, and the end of the drain pipe portion is directed away from the viewer in the plane orthogonal to the side elevation illustrated.

Figure 4:
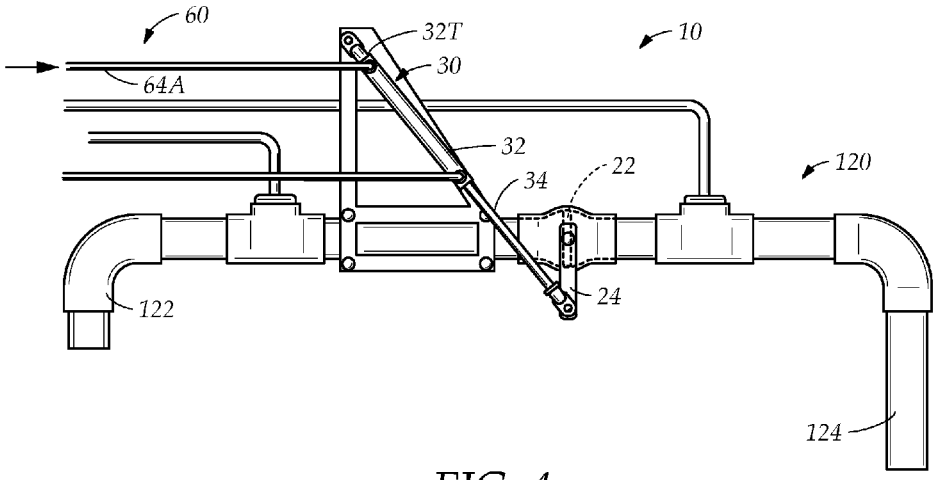
FIG. 4 is a side elevational view of the pneumatic valve in cross-section, showing the valve closed for applying air pressure to a drain pipe portion connecting to a drain pan of the condensate drainage system.

FIG. 4 shows the drain cleaning system 10 beginning an initial blow-out cycle for cleaning the drain pipe 120. Inside the controller, which is not shown, are a plurality of solenoid valves that direct air flow through the air lines 60. When the controller receives a signal that the condensate level is high in the drain pan, the controller opens a first solenoid valve to admit compressed air into the pneumatic cylinder 30, the air flowing into the air line 64A at the top 30T of the cylinder barrel 32. The compressed air extends the piston rod 34 of the pneumatic cylinder 30, forcing the valve lever 24 downward into the vertical position. The lever 24 moves the main valve 22 into the vertical position, closing the main valve 22, shutting the connection between the outlet pipe portion 122 and the drain pan portion 124 of the drain pipe 120.

Figure 6:
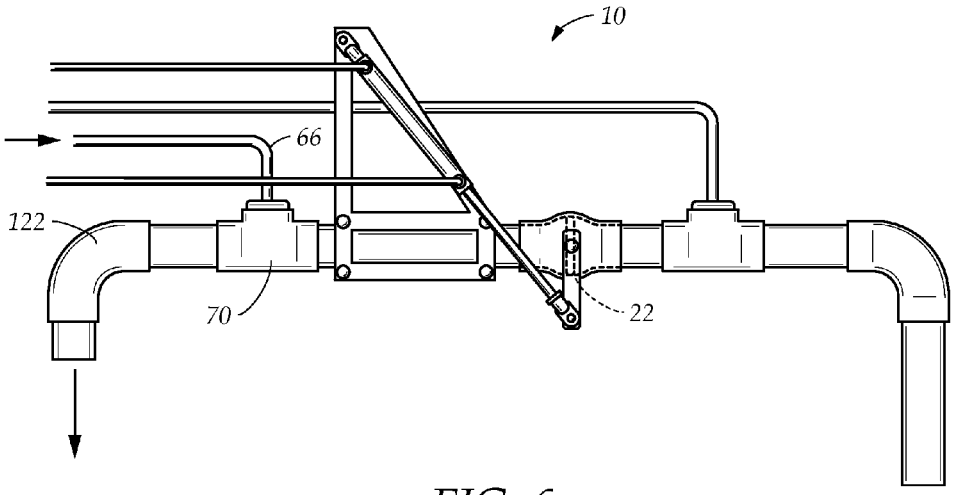
FIG. 6 is a side elevational view of the pneumatic valve in cross-section, showing the valve closed air pressure entering the drain pipe portion connecting to the drain pan.

FIG. 6 shows the next step in the cycle of the drain cleaning system 10. The controller opens a second solenoid valve, the solenoid valve opening and closing rapidly to introduce a shot of high pressure compressed air into the air line 66 connecting to the tee-connector 70 inserted in the drain pan pipe portion 122. The high pressure air shot forces any clog between the main valve 22 and drain pan back into the drain pan out of the drain pan pipe portion 122.

Figure 5:
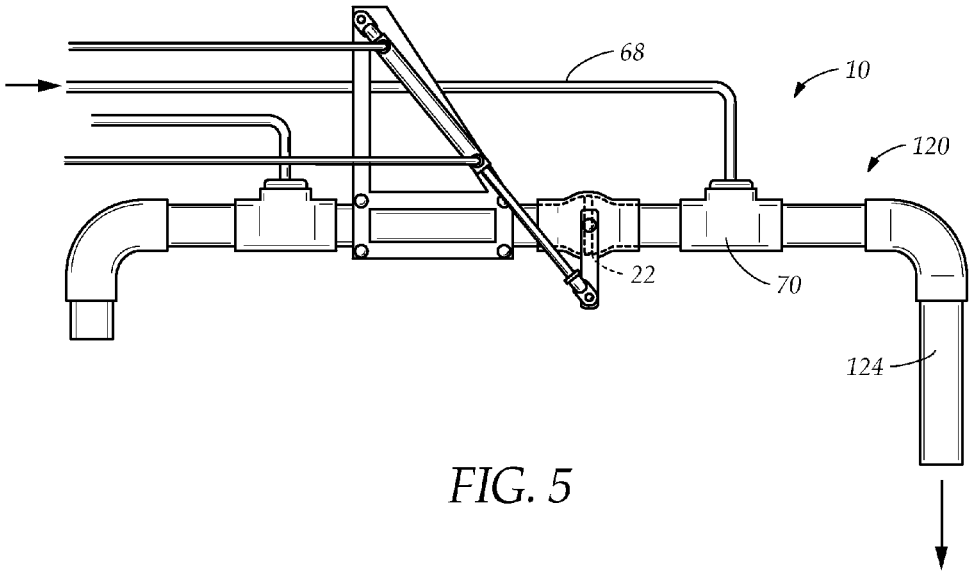
FIG. 5 is a side elevational view of the pneumatic valve in cross-section, showing the valve closed and air pressure entering the drain pipe portion connecting to an outlet.

FIG. 5 shows the next step in the cycle of the drain cleaning system 10. The controller opens a third solenoid valve, the solenoid valve opening and closing rapidly to introduce a shot of high pressure compressed air into the drain air line 68 connecting to the tee-connector 70 inserted in the outlet pipe portion 124. The high pressure air shot forces any clog between the main valve 22 and the outlet 130 out of the drain pipe 120.

FIG. 3 shows the final step in the blow-out cycle of the drain cleaning system 10. The solenoid valve in the controller that regulates the compressed air to the pneumatic cylinder admits compressed air into the bottom 32B of the cylinder barrel 32, forcing a piston inside the cylinder barrel 32 upward, retracting the piston rod 34. When the piston rod 34 retracts, the valve lever 24 is pulled upwards into the horizontal position, and likewise moving the main valve 22 into the horizontal position, opening the drain pipe 120 to condensate flow.

Figure 7:
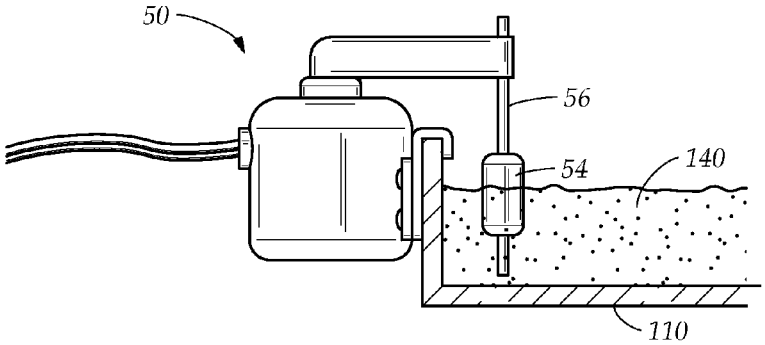
FIG. 7 is a side elevational view of a float level switch assembly with a float sensor in the drain pan, showing a high level of condensate in the drain pan.

FIG. 7 shows the float level switch assembly 50 prior to the valve opening after the blow-out cycle, the float 54 signaling a high level of condensate 140 in the drain pan 110. If the completed blow-out cycle is successful, the condensate level 140 begins to drop and the float 54 moves downward on the rod 56, opening the circuit with the controller. FIG. 8 shows the float 54 dropping as the condensate 140 level drops, indicating the drain pipe is clear and the clog removed. The controller resets the system.

If the float 54 does not drop, remaining high on the rod 56 as shown in FIG. 7, indicating that there is a high condensate 140 level in the drain pan 110, the controller repeats the blow-out cycle. The controller has a logic control printed circuit board using Boolean logic. After the valve is opened, the controller waits a set time interval for a signal that the condensate 140 level has lowered and the drain pipe is clear. If the float 54 does not drop within the set time interval after the valve opens, the logic circuit computes the answer to the proposition: "Is the drain clear?" as FALSE.

Referring to FIG. 4, the controller signals the first solenoid valve to open to supply compressed air to the out-stroke air line 64A, extending the piston rod 34 of the pneumatic cylinder 30, forcing the valve lever 24 downward into the vertical position, closing the main valve 22. As drawn in FIG. 6 and FIG. 5, the controller signals the second solenoid valve to supply a more forceful pair of air pressure shots at a pressure higher than the shots in the initial blow-out cycle, delivering one shot to each of the tee-connectors 70. As shown in FIG. 3, the controller pneumatically opens the main valve 22 to allow the condensate to flow through the drain pipe 120. If the drain pipe 120 is successfully cleared, as illustrated in FIG. 8, the condensate level 140 in the drain pan 110 drops and the float 54 on the rod 56 moves down, breaking the circuit and signaling the controller. If the float drops within the set time interval after the valve has been opened, the logic circuit computes that the answer to the proposition: "Is the drain clear?" is TRUE.

Referring to FIG. 3 through FIG. 6, if the controller does not receive the signal that the drain pipe 120 is clear after a set time, the controller initiates a second blow-out cycle, closing the main valve 22, using a more forceful pair of shots of e air, at a pressure higher than the shots in the previous blow-out cycle to each of the tee-connectors 70. The blow-out cycles are repeated with an incremental increase of pressure with each cycle until the controller receives the signal from the float level switch assembly that the drain pipe 120 is clear or until the pressure transducer signals that the maximum pressure has been reaches, tripping an alarm. The controller does not reset the system until the drain pipe 120 is clear or until the maximum pressure is reached. When the controller receives the signal, the controller resets the system and the system becomes idle.

In a further embodiment, when the controller receives the signal that the clog is clear, the controller initiates a rinse cycle to inhibit further clogging. The controller opens an additional solenoid valve to rinse with a descaling, degreasing and disinfecting chemical rinse, using a regulated pressure pot, a pump or gravity feed from a reservoir. If the system has the regulated pressure pot, the compressed air source driving the pneumatic cylinder and blowing out the drain pipe is used to power the pressure pot. The chemical rinse is applied to the coils and drain pan initially, flowing through the drain pan into the drain pipe to completely flush the condensate drainage system. After the rinse is complete, the controller resets the system and the system becomes idle.

Figure 9:
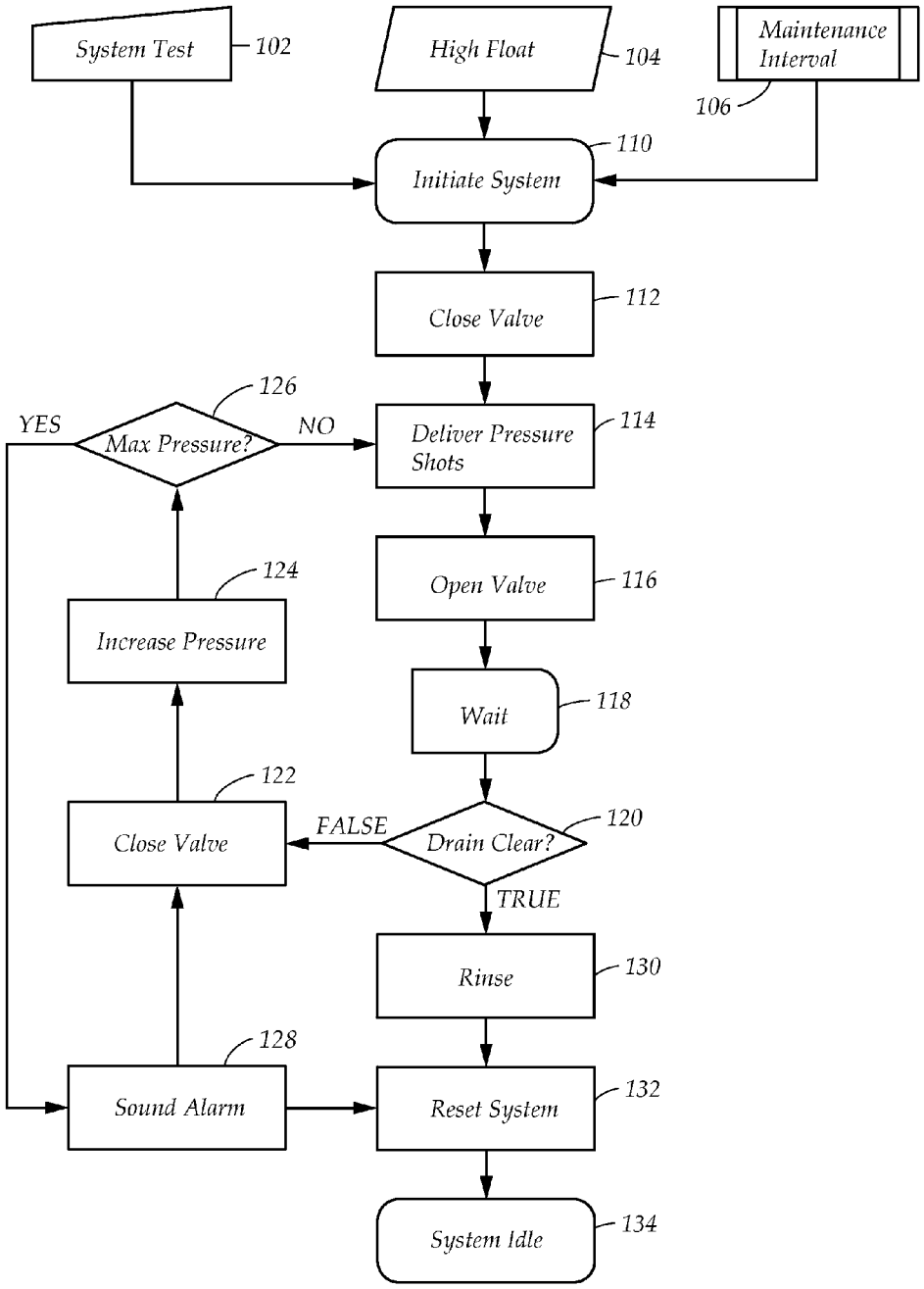
FIG. 9 is a flow chart showing an automatic drain cleaning cycle.

FIG. 9 outlines in a flow chart, the process the system follows. The drain cleaning system is initiated 110 either manually by the user to test the system 102, particularly after seasonal idleness, automatically at a pre-set interval determined by the user to maintain the system 106 or in response from a signal from the float level switch 104 indicating a high condensate level in the drain pan caused by clogging. When the system initiates 110, the controller opens a first solenoid valve to actuate the pneumatic cylinder to close the valve 112. The controller opens the second and third solenoid valve and delivers a pair of air pressure shots 114. The controller opens the valve by actuating the pneumatic cylinder 116. The controller waits a set time interval 118 for the float level switch to signal that the condensate level is lower in the drain pan and the drain pipe is clear. If the controller does not receive a signal after the set time interval, the controller computes that the drain is not clear, that the answer to the proposition: "Is the drain pipe clear?" 120 is FALSE and initiates the second cycle of air pressure shots. The controller closes the valve 122 to start the next blow-out cycle. The controller increases the force of the air pressure shots 124 by increasing the pressure. At each repeat cycle, the system determines if the maximum pressure has been reached 126 before delivering the pair of pressure shots 114. If the maximum pressure is reached, the system signals an alarm 128 and resets 132. The system delivers the pressure shots 114, the system opens the valve, the controller waits for the float level switch to signal 118. If the answer to the question: "Is the drain pipe clear?" 120 is still FALSE, the system initiates yet another blow-out cycle as described hereinabove, with another incremental increase in pressure. The system repeats the blow-out cycle until the answer to the question: "Is the drain pipe clear?" 120 is TRUE. When the drain is clear, the controller resets the system 132 and the system is in the idle state 134.

In one embodiment, when the drain is clear, the controller opens a solenoid valve to rinse the coils and pan with the descaling, degreasing and disinfecting chemical rinse 130. The controller resets the system 132 and the system is in the idle state 134, the same as the system described hereinabove without the chemical rinse step.

Referring to FIG. 1, the illustration shows an exemplary installation of the system. The air conditioning system has the evaporator 102 sitting in the drain pan 110. Connected to the drain pan 110 is the drain pipe 120 having the outlet 130 that leads to the ground or to the sewage system. To install the drain cleaning system 10, the drain pipe 124 is bisected into two portions 122, 124. The pipe segment 16 with the valve is inserted between the drain pipe portions 122, 124. Connected the pipe segment 16 to the drain pipe portions is a pair of tee-connectors 70, the horizontal segments 72 of the tee-connector 70 attaching the ends of the pipe segment 16 to the drain pipe portions 122, 124, one tee-connector 70 on each end of the pipe segment 16 attaching to each drain pipe portion 122, 124. Clamped onto the pipe segment 16 is the bracket 18 for the pneumatic cylinder 30. The clevis 36 of the pneumatic cylinder 30 is attached to the lever 24 of the valve, the lever opening and closing the valve, the lever operated by the pneumatic cylinder 30. The plurality of air lines 60 connect to the pneumatic cylinder 30, operating the cylinder to open and close the valve and to the vertical segment 74 of the tee-connectors 70 for blowing out the drain pipe portions 122, 124. Attached to the side of the drain pan 110 is the float level switch assembly 50 with the float on the rod 54 hanging from the arm 52 into the drain pan 110 and the housing 58 of the assembly on the outside wall 112X of the drain pan. The float level switch assembly 50 connects to the controller 40, signally the change in level of the condensate in the drain pan. In this example, the float level switch assembly electrically connects by wire 12 to the controller, but other ways of connecting such as by radio waves and other wireless methods of transmission are possible within the inventive concept.

The controller 40 is in a housing 42, having a display panel 44 and a plurality of buttons 46 for selecting various control parameters. The display panel displays the control and operating parameters as well as the high pressure alarm. Display of the high pressure alarm is maintained until manually cleared. The buttons 46 use soft button technology to accomplish the various tasks required to program the system. In one embodiment, control and operating parameters are set by a remote control connecting either wirelessly or wired to the controller 40, the controller 40 providing data on the system operation and the high pressure alarm signal back to the remote control. The remote control can be for example, but is not limited to, a smart phone, a handheld computing device or a computer. The controller 40 has a plurality of solenoid valves attaching to the various air lines 60 through the manifold 48 in the housing 42. The controller 40 has the logic control printed circuit board, as well as a plurality of relays, at least one pressure transducer, a plurality of switches and other typical controller components that are well known to those of ordinary skill in the art and are beyond the scope of this discussion. In one embodiment, the controller connects to the air conditioning system, shutting down the system prior to clearing the drain and turning on the system after the clearing cycle is successfully completed. In another embodiment, the controller shuts down the AC and transfers power and turns on the air compressor to generate air pressure for the system prior to actuating the pneumatic cylinder to close the valve and initiating the first blow-out cycle. In yet another embodiment, the controller turns on the chemical rinse to flush the system to inhibit clog formation.

In conclusion, herein is presented an air conditioning drain cleaning system with an automated blow-out cycle to clean out an air conditioner evaporator drain pipe. The invention is illustrated by example in the drawing figures, and throughout the written description. It should be understood that numerous variations are possible, while adhering to the inventive concept. Such variations are contemplated as being a part of the present invention.

What is claimed is:

1. An air conditioning (AC) drain cleaning system installed on an AC condensate drainage system, the drainage system having a drain pan and a drain pipe for draining condensate from the drain pan to an outlet, comprising:

a compressed air source;

a float level switch assembly, the float level switch assembly having a housing, a rod, an arm, the float disposed on the rod and floating on condensate in the drain pan, the rod suspended from the arm, and a switch, the switch inside the housing, the switch connected to the float by the arm such that when the float rises, the arm rises completing a circuit in the switch, signaling a high level of condensate in the condensate drainage system indicating a clog and when the float drops, the arm dropping, breaking the circuit, signaling a low level of condensate in the condensate drainage system indicating the drainage system flowing freely;

a plurality of air lines in a manifold, the manifold connecting to the compressed air source;

a controller, the controller having a plurality of solenoid valves selectively opening and closing to introduce compressed air into the air lines, the controller having a pressure transducer for detecting when the maximum system pressure is achieved, the controller receiving signaling from the float level switch assembly indicating a clog in the condensate drainage system; and a pneumatic valve assembly, having a pipe segment with an internal main valve, the main valve having an external lever, the pipe segment having a pair of ends and a pair of tee-connectors, one of said tee-connectors attached on each end, the pneumatic valve assembly bisecting the drain pipe into a pair of portions and connecting the pair of portions to the tee-connector at the end of its associated pipe segment, the tee-connectors each having a vertical segment, the vertical segment connecting to one of the air lines, the pneumatic valve assembly having a pneumatic cylinder, the pneumatic cylinder having a cylinder barrel, a piston rod with a clevis, the clevis attaching to the main valve lever; the pneumatic cylinder connecting to at least one air line, the controller opening a first solenoid valve on the air line to the cylinder barrel in response to the float level switch assembly signal that the condensate drainage system is clogged, extending the piston rod to selectively rotate the main valve lever into a closed position, closing the main valve, the controller opening a second solenoid valve, introducing a first shot of compressed air to a first tee-connector and opening a third solenoid valve, introducing a second shot of compressed air to a second tee-connector, blowing out the clog from the drain pipe, the controller selectively opening the first solenoid valve to the cylinder barrel, retracting the piston rod to selectively rotate the main valve lever into an open position, opening the main valve, completing a cycle, the controller waiting a preset time for the float level switch assembly to signal that the drainage system is freely flowing, and the controller not receiving the signal in the preset time such that the controller selectively repeats the cycle of closing the main valve, incrementally increasing force of the pair of compressed air shots, and opening the main valve until the float level switch assembly signals that the drainage system is freely flowing within the preset time or until the pressure transducer detects the maximum system pressure is achieved.

2. The AC drain cleaning system as described in claim 1, wherein the controller signals a release of a chemical rinse into AC condensate drainage system after receiving the signal that the drainage system is freely flowing.

3. An air conditioning (AC) drain cleaning system installed on an AC condensate drainage system, the drainage system having a drain pan and a drain pipe for draining condensate from the drain pan to an outlet, comprising:

a compressed air source;

a plurality of air lines in a manifold, the manifold connecting to the compressed air source;

a controller, the controller having a plurality of solenoid valves selectively opening and closing to admit compressed air into the air lines the controller having a pressure transducer;

a pneumatic valve assembly, having a pipe segment with an internal main valve, the main valve having an external lever, the pipe segment having a pair of ends and a pair of tee-connectors, one of said tee-connectors attached on each end, the pneumatic valve assembly bisecting the drain pipe into a pair of portions and connecting the pair of portions to the tee-connector at the end of its associated pipe segment, the tee-connectors each having a vertical segment, the vertical segment connected to one of the air lines, the pneumatic valve assembly having a pneumatic cylinder, the pneumatic cylinder having a cylinder barrel, a piston rod with a clevis, the clevis attaching to the main valve lever; the pneumatic cylinder connecting to at least one air line, the controller opening a first solenoid valve on the air line to the cylinder barrel, extending the piston rod to selectively rotate the main valve lever into a closed position, closing the main valve, the controller opening a second solenoid valve, introducing a first shot of compressed air to a first tee-connector and opening a third solenoid valve, introducing a second shot of compressed air to a second tee-connector, blowing out the clog from the drain pipe, the controller selectively opening the first solenoid valve to the cylinder barrel, retracting the piston rod to selectively rotate the main valve lever into an open position, opening the main valve, completing a cycle; and a float level switch assembly, the float level switch assembly having a housing, a rod, an arm, the float disposed on the rod and floating on condensate in the drain pan, the rod suspended from the arm, and a switch, the switch inside the housing, the switch connected to the float by the arm such that when the float rises, the arm rises completing a circuit in the switch, signaling to the controller the presence of a high level of condensate in the condensate drainage system indicating a clog such that the controller initiates the cycle of closing the main valve, of introducing the pair of shots of compressed air into the tee-connectors, and of opening the main valve, the controller waiting a preset time for the float level switch assembly to signal that the draining system is freely flowing, the controller not receiving the signal in the preset time such that the controller selectively repeats the cycle of closing the main valve, incrementally increasing force of the pair of compressed air shots, and opening the main valve until the float level switch assembly, including the arm, drops to break the circuit, signaling a low level of condensate in the condensate draining system and indicating that the drainage system is freely flowing within the preset time or until the pressure transducer detects that the maximum system pressure is achieved.

4. The AC drain cleaning system as described in claim 3, wherein the controller signals a release of a chemical rinse into AC condensate drainage system after receiving the signal that the drainage system is freely flowing.

* * * * *